United States Patent [19]

Brownbill

[11] 4,196,818

[45] Apr. 8, 1980

[54] CLOSURES FOR CONTAINERS

[75] Inventor: Thomas D. Brownbill, West Bromwich, England

[73] Assignee: Metal Closures Group Limited, London, England

[21] Appl. No.: 897,096

[22] Filed: Apr. 17, 1978

[30] Foreign Application Priority Data

Dec. 14, 1977 [GB] United Kingdom ..... 52052/77
Mar. 9, 1978 [GB] United Kingdom ..... 9341/78

[51] Int. Cl.[2] ..... B65D 41/34; B65D 41/36; B65D 41/38

[52] U.S. Cl. ..... 215/252; 215/344; 215/DIG. 1; 113/121 A; 53/485

[58] Field of Search ..... 215/252, 270, 344, DIG. 1; 113/121 A; 53/41, 42

[56] References Cited

U.S. PATENT DOCUMENTS

| | | | |
|---|---|---|---|
| 3,067,900 | 12/1962 | Kessler | 215/344 |
| 3,203,571 | 8/1965 | Plunkett | 215/DIG. 1 |
| 3,737,064 | 6/1973 | Patel | 215/252 |
| 3,986,627 | 10/1976 | Zapp | 215/344 |
| 4,061,240 | 12/1977 | Brownbill | 215/344 |

FOREIGN PATENT DOCUMENTS

| | | | |
|---|---|---|---|
| 965734 | 4/1975 | Canada | 215/252 |
| 2349265 | 4/1974 | Fed. Rep. of Germany | 215/252 |
| 1347837 | 11/1963 | France | 215/252 |
| 2290364 | 6/1976 | France | 215/252 |
| 2310932 | 12/1976 | France | 215/252 |
| 1438648 | 6/1976 | United Kingdom | 215/252 |

*Primary Examiner*—George T. Hall
*Attorney, Agent, or Firm*—Stevens, Davis, Miller & Mosher

[57] ABSTRACT

The present invention is concerned with a one-piece pressure resistant container closure including a pilfer proof ring and associated sealing means provided in or towards the crown of the closure whereby it is possible to apply the closure to a container without substantial risk of rupture between a skirt extension portion of the closure constituting a security ring and the remainder of the closure. To this end, there is provided in combination a closure having a crown portion and a skirt depending from the periphery of the crown portion, the skirt including retaining means to cooperate with corresponding means to retain the closure about a container neck, and characterized by a flexible annular sealing ring depending from an internal surface of the closure inclined inwardly towards the closure axis and adapted to engage in sealing relationship with a container neck, a support ring juxtaposed the sealing ring to limit flexing of the sealing ring on application of the closure to a container, the skirt extension having a pilfer proof security portion which, on application to the container neck enters over a security band portion on the neck of the container without rupture.

8 Claims, 8 Drawing Figures

CLOSURES FOR CONTAINERS

The present invention relates to pressure resistant closures for containers and has particular reference to a closure having an improved pilfer proof or tamper proof seal or ring. At the same time, the invention has particular reference to a closure which is essentially formed from a one-piece moulding and incorporates the twin facilities of a pilfer proof or tamper proof seal and a pressure resistant seal.

Glass containers having a screw threaded type closure adapted to accommodate gasified goods such, for example, as lemonade, tonic water, soda water and the like, are generally well known. There is at present no indication provided with such containers as to whether the goods have been adulterated or not, and furthermore, there is frequently the occasion when a consumer purchases such goods and finds that the contents of the container are "flat," that is to say have lost, to a large extent, their gasified properties.

At the present time, these containers are generally provided with generally metal closures which have a sealing liner in the cap thereof so that on application of the closure to the bottle or container interaction of the screw thread between the closure and the container and also on the application of such top pressure as may be applied, draws the closure down on to the neck of the container so that the liner engages the rim of the container neck to deform the same and to effect a seal between the liner and the container neck itself.

The manufacture of such articles involves the formation of the closure and the insertion and/or formation of the liner in the closure itself. While this is a relatively simple operation, and has been practiced for many years, the insertion of the liner is becoming increasingly more expensive and there is considerable advantage in the use of a plastics material itself to take up the slight imperfections of the container neck.

With the desirability, however, of providing a pilfer proof seal, it then becomes that much more difficult to insert the liner into the closure.

Pilfer proof or tamper proof rings about the lower end of the skirt of the closure are generally well known and it has been proposed to provide such a ring with a tear strip or line of rupturable bridges defining a line of weakness between the skirt extension constituting the pilfer proof ring and the lowermost extremity of the skirt depending from the crown of the closure itself.

Hitherto, the interengagement between the pilfer proof ring on the one hand and the container neck on the other, has comprised an inwardly projecting barb or bead provided on the internal surface of the security ring adapted to snap over the corresponding security band or flange on the neck of the container so that once it is on, it is not possible to remove the closure without tearing the weakened portion between the pilfer proof ring and the closure or, in the alternative, removing the pilfer proof ring in toto, thus indicating clearly to a consumer that the contents of that particular container may well have been sampled.

The principal disadvantage of this arrangement is that, when applying a pilfer proof ring/closure assembly to a container in the first instance, it is necessary to "snap over" the engaging bead or barb on the pilfer proof ring with a corresponding engaging portion on the neck of the container. To do this, the bead or barb which is usually of thicker section than the material of the rest of the pilfer proof ring has to be stretched and the torque or force required to do this and to drive the thickened bead or barb over the engagement portion of the container neck is usually quite high. In general, it is a problem that the force required approaches or even exceeds that at which rupture of the weakened portion between the pilfer proof ring and the closure proper takes place and, in consequence, a number of containers have to be resealed as a result of failure of the pilfer proof ring during application of the closure.

According to the present invention, there is provided a pilfer proof closure for a container having an upstanding neck defining a dispensing opening and having a security band portion on the external neck surface, said closure comprising a crown portion adapted to overlay and close said dispensing opening, a skirt depending from the periphery of said crown portion including on the internal surface of the skirt retaining means adapted to cooperate with corresponding retaining means provided on the container neck, a flexible annular sealing ring depending from an internal surface of the closure and inclined inwardly towards the axis of the closure, said sealing ring being adapted to engage in sealing relationship with the container neck, a support ring depending from said crown portion and disposed substantially concentrically within said sealing ring to limit flexing of the sealing ring on application to a container neck and a skirt extension having a pilfer proof security portion which on application to the container neck enters over the security band portion on the container neck without rupture.

By "security band portion" as used herein in relation to the construction of the neck of a container is to be understood to include any bead, flange, rib, band or expanded portion or any groove, recess or slot which is adapted to engage a projection on the pilfer proof ring for retention thereof against the action of closure removal.

The skirt extension preferably includes a plurality of tongue elements each hingedly connected with the skirt extension and adapted to extend inwardly thereof to engage the security band portion on the container neck and a rupturable portion disposed between the tongue elements and the closure skirt whereby removal of the closure from the container neck results in breaking of the rupturable portion to leave the skirt extension about the container neck thereby indicating that the container contents have been sampled.

On application of the closure to the container the tongue elements readily hinge upwards to pass over the cooperating retaining means on the container neck without exertion of torque or force sufficient to break the rupturable portion.

The skirt extension may terminate at its lower extremity in an outwardly extending bead for strengthening purposes.

The plurality of tongues may be stamped, cut or otherwise formed juxtaposed the bead so that the extremity of the tongue extends upwardly and inwardly of the bead to hinge along the line juxtaposed the upper extremity of the bead.

The rupturable portion may comprise a plurality of circumferential splits extending around the skirt extension between the plane of the tongue elements and the plane defined by the lower extremity of the skirt of the container. The pilfer proof ring may further include at least one axial line of weakness extending between the peripheral line of weakness constituting the rupturable portion; a strengthening bridge may be provided juxtaposed said axial line of weakness across the rupturable portion whereby on removal of the closure from the container, the rupturable portion ruptures but the strengthening bridge holds and causes further rupturing along the axial line of weakness so that the skirt extension is removed completely from the container neck.

This latter embodiment has some considerable advantage since the hinged nature of the tongue means that as the closure is withdrawn from the container neck the hinge line is drawn upwardly and the tongues pivot about the extremity of engagement with the cooperating portion on the container neck so that the hinge line is urged outwardly to expand the bead and assist tearing of any axial line of weakness.

As an alternative to the formation of the tongues and rupturable portion on the closure prior to application to a container, the pilfer proof closure may be applied to the container and the tongues and rupturable portion stamped or otherwise formed in situ on the container neck.

The invention further includes a method of closing a container which comprises applying a closure in accordance with the present invention and thereafter stamping out the tongues inwardly under the security band portion on the container neck either separately or simultaneously forming the lines of weakness constituting the rupturable portion. An axial line of weakness may be formed at the same time if desired.

The arrangement of the sealing ring and the support ring of the closure if preferably such that they urge the sealing ring into further sealing engagement with the neck of the container to which the closure is applied. The internal surface of the skirt juxtaposed the sealing ring may include an inwardly projecting annular bead which, when the closure is applied to the container, abuts the surface of the neck thereof juxtaposed the ring and serves to center the closure on the container neck as the components are brought into sealing engagement and at the same time serves to take up and deform in response to any slight irregularity in the finish of the container neck per se.

The sealing ring may be a flexible annular ring extending inwardly from the crown and/or skirt of the closure and it is preferred that the sealing ring extends inwardly from the junction of the crown and the skirt to define a ring of generally frusto-conical form which decreases in overall diameter with increasing spacing from the crown. The outer extremity of the ring on that portion adapted to engage the neck of the container may have an annular sealing member. The annular sealing member may itself include a sealing surface adapted to engage the rim of the container neck and the sealing surface may carry one or more ribs each adapted to make line contact with the neck of the container. The pressure of the contents of the container are arranged to act upon the sealing ring by permeating between the abutting surface of the support ring and the back of the sealing ring when the closure is in sealing engagement with the container. The imperfections between the sealing ring and the support ring are sufficient to allow pressure to build up in the annular space defined by the support ring, the crown, the skirt and the "back" of the sealing ring so that said additional pressure serves to urge the ring into further sealing engagement with the neck of the container. This additional sealing occurs by further flexing of the sealing ring into the low pressure area of the closure towards the skirt.

In an alternative embodiment of the present invention, the support ring may have one or more interruptions to allow pressure to enter behind the ring in a manner described above.

At the same time, the inwardly directed annular bead engages the upper extremity of the container neck and serves to locate and center the closure before maximum closure and sealing torque is finally applied.

The depth of the support ring is preferably selected so that the sealing ring is brought into abutting engagement therewith without the sealing surface being flexed at an angle such that the sealing surface passes through the perpendicular to the axis of the closure. With this arrangement the harder the closure is applied to the container, the greater is the sealing force applied directly to the sealing ring. Imperfections between the sealing ring and the support ring serve to allow permeation of pressurized gas into the annulus defined by the lack of the sealing ring, adjacent portions of the skirt, and crown of the closure of the annular support ring thereby causing further flexing of the ring radially outwardly of the support ring to increase the sealing engagement one with the other.

In accordance with the preferred embodiment of the present invention, the higher the pressure of the contents the more effective the sealing of the sealing ring, while an interference fit is obtained between the annular bead and the neck of the container.

The invention described above provides the twin advantages of a one-piece plastic cap incorporating a pilfer proof or tamper proof security ring on the one hand and a built-in positive seal on the other. This is achieved without the considerable problem of providing an inner sealing liner into a closure having a skirt extension.

Following is a description by way of example only and with reference to the accompanying drawings of embodiments of closures in accordance with the present invention.

Figure 2:
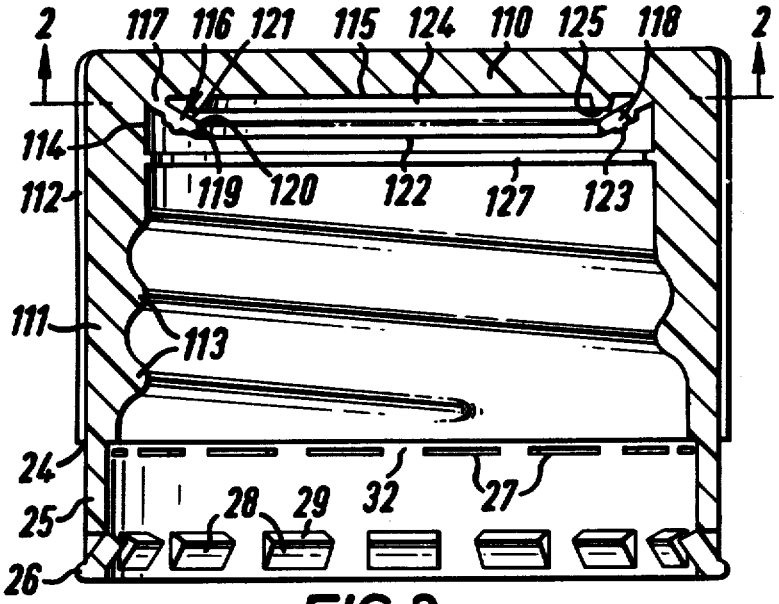
FIG. 2 is a section of the closure in accordance with the present invention.
Figure 3:
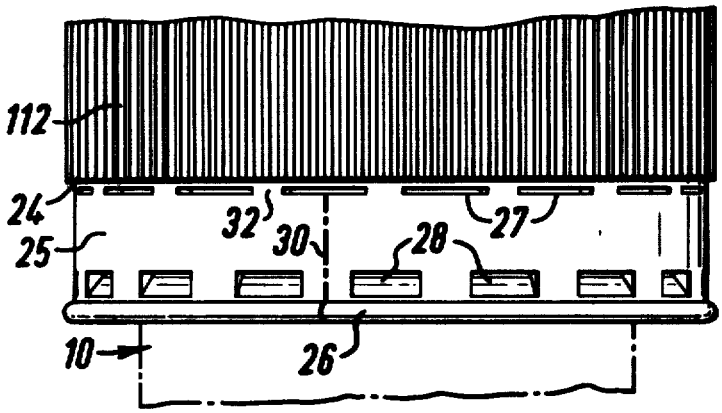
FIG. 3 is an elevation of part of the closure of FIG. 2.
Figure 3A:
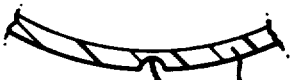
Figure 4:
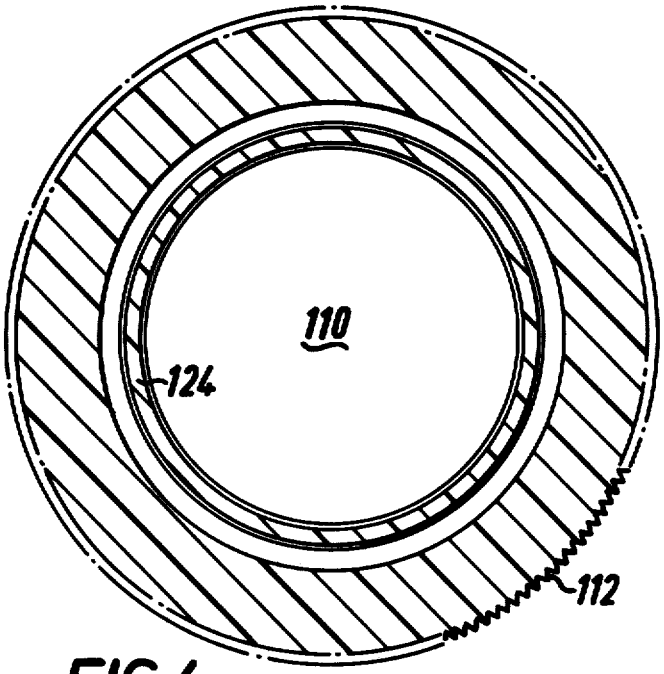
Figure 5:
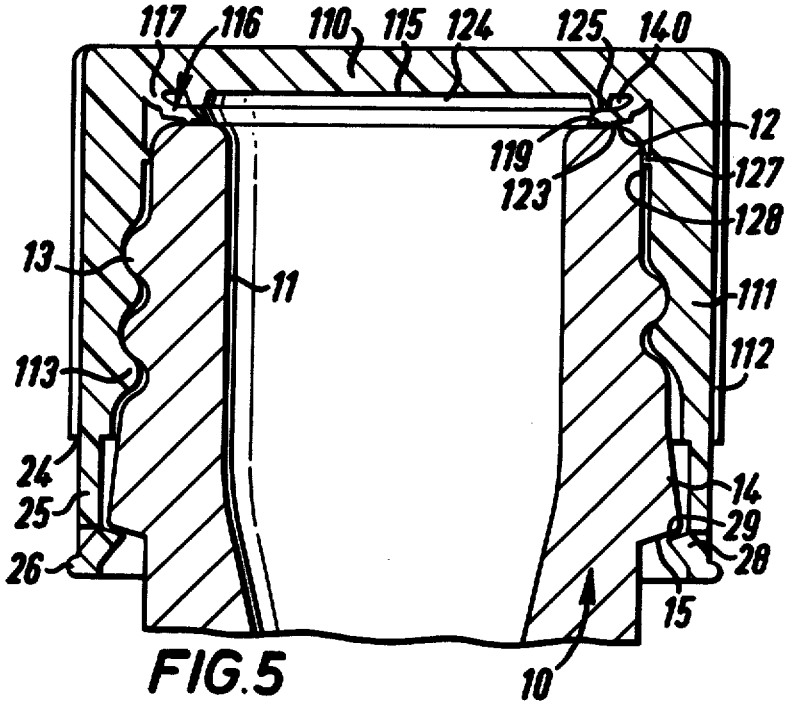
Figure 6:
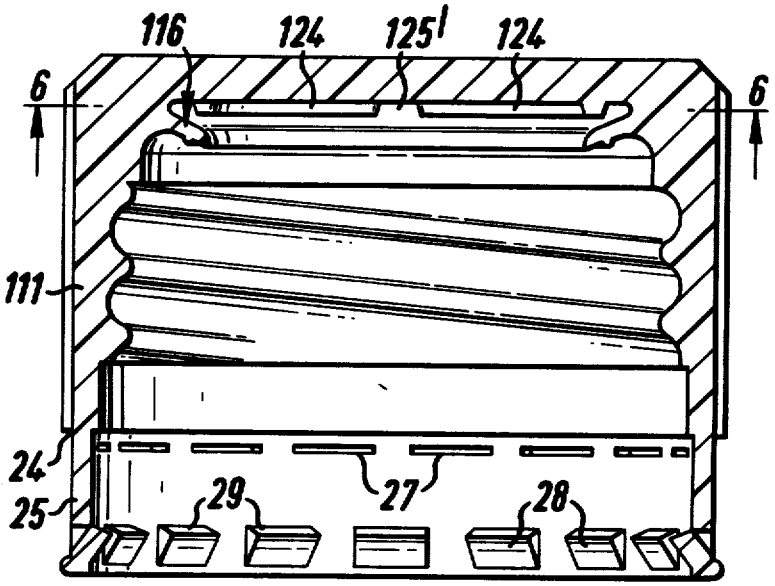
Figure 7:
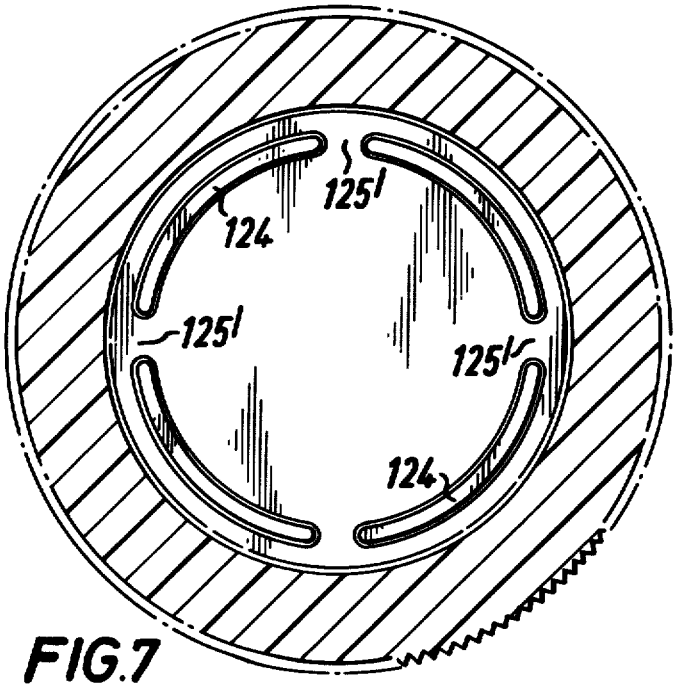

FIG. 3*a* is a diagrammatic view of part of a security ring of the closure of FIG. 2;

FIG. 4 is a section on the line II—II of FIG. 2;

FIG. 5 is a section of the closure of FIG. 2 when applied to a container showing the sealing arrangement and the interengagement of the pilfer proof ring and the closure;

FIG. 6 is an alternative arrangement of the sealing assembly of FIG. 2;

FIG. 7 is a section along the line 6—6 of FIG. 6.

Figure 1:
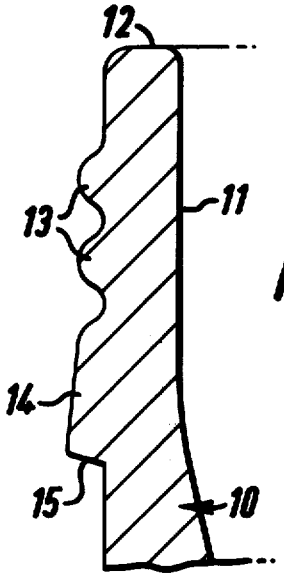
FIG. 1 is a part section of the neck of the container to which the closure is to be employed.

The upstanding neck 10 of a container shown in FIG. 1 has a substantially smooth internal surface 11 and is substantially cylindrical to define a dispensing opening. The neck 10 terminates in an annular rim 12 and the external surface of the neck is provided with screw threads indicated at 13. A thickened security band 14 is provided below the threads 13 and provides an annular ridge 15 for engagement with the security ring of a closure to be applied to the container neck.

A closure has a substantially circular crown portion 110 and a depending cylindrical skirt 111, the outer cylindrical surface of which skirt is preferably knurled at 112 to assist manipulation by a user. The depending skirt 111 is provided on its inner surface with screw threads 113 adapted to co-operate with threads 13 provided on the container neck. The lower extremity 24 of cylindrical skirt 111 is provided with a depending cylindrical security ring 25 which terminates at its lower end in an outwardly projecting annular bead 26. Juxtaposed the lower extremity 24 of cylindrical skirt 111 there is provided in the security ring 25 a circumferential line of slots 27 to define a line of weakness constituting a rupturable portion.

Towards the lower end of security ring 25 there is provided a plurality of circumferentially spaced tongues 28 hingedly connected to security ring 25 so that the tongues project inwardly of security ring 25 and upwardly thereof to provide an abutment surface 29. The tongues 28 are hingedly connected to the security ring 25 so that the tongues 28 can hinge outwardly to lie substantially in the plane of the security ring but have a residual bias inwardly to the position and attitude described above and as shown in FIG. 2.

On application of such a closure to the container the closure together with the security ring is simply entered over the container neck and screwed on in the usual way. As each tongue enters over the security band 14, the inner extremity of tongue 28 engages the outer surface of the band and the tongue is hinged inwardly towards the plane of security band 25. Progressive application of the closure to the container allows the tongue 28 to ride along the slightly inclined outer surface of the security band 14 until the extremity of tongue 28 is juxtaposed the engagement surface 15. The residual bias of the tongue 28 then allows the tongue to project inwardly as shown in FIG. 2 so that an attempt to remove the closure will result in upward withdrawal of the security ring and to bring the abutment surface of the tongue into engagement with the ridge 15 of the security band 14 of the neck of the container. Continued application of torque to the closure would cause the tongue 28 to hinge outwardly about the abutment surface to splay bead 26 and to provide a downward resistance to removal of the closure. When the torque applied is greater than the residual strength of the rupturable portion defined by the line of weakness constituted by slots 27 is reached, the bridging portions between the slots will tear thus separating the closure from the security ring. Thus, unauthorized tampering with the closure will thus result in a clear indication to the consumer that the contents of the container may have been sampled.

In an alternative embodiment of the present invention an axial line of external or internal weakness 30 may be provided in the security ring 25 extending from a slot 27 to and through the annular bead 26. This line of weakness may be formed by a reduction in thickness by the provision of a groove 31 in one or other surfaces of the security ring (see FIG. 3A). With this embodiment a strengthened bridge 32 may be provided adjacent the axial line of weakness 30 so as to induce tearing of the line of weakness 30 as the closure is removed in order to remove the security ring with the closure. The security ring may then be torn off the closure once removed from the container neck and the closure reapplied to the container as required by the consumer.

The internal surface of the skirt 111 is provided with a screw thread 113 and the junction between an internal surface 114 of the skirt and the inner surface of the crown 115 is provided with a generally frusto-conical inwardly directed flexible ring 116. The ring 116 juxtaposed the junction of internal surface 114 and inner surface 115 comprises a first flexible portion 117 and a second outer sealing member 118. The second outer sealing member 118 has a lower sealing surface 119 and an upper curved surface 120 merging continuously with a back surface 121. The upper curved surface 120 and the sealing surface 119 together define an annular extremity 122 of the ring and the lower sealing surface has an annular bead 123.

The crown of the closure constituted by disc 110 carries an annular support ring 124 generally concentric with the disc 110 and spaced inwardly of the junction of sealing ring 116 with the crown and the skirt. The annular support ring depends from the inner surface 115 of the crown and is generally trapezoidal in cross-section decreasing in cross-section in a direction downwardly and away from the crown. The annular support ring has a substantially annular surface 125 which is adapted to engage with and abut the back surface 121 of the sealing ring when the latter is flexed.

Towards the junction of the sealing member 117 with the skirt 111 there is provided in the surface of the skirt above the upper extremity of the thread 113 a radially inwardly directed bead 127 which is adapted to engage with and abut the periphery 128 of neck 10 juxtaposed the annular neck rim 12.

In use, the closure is applied to the neck 10 of the container by engaging the screw thread 113 on the internal surface of the skirt 111 with corresponding thread 13 on the external surface of neck 10. By screwing the closure onto the container neck 10 the extremity 122 of the sealing ring 116 is brought into contact with rim 12 defining the extremity of the container neck. Continued application of the closure results in flexing of the flexible portion 117 of the ring 116 to bring the lower sealing surface 119 into juxtaposition with rim 12 with the annular bead 123 carried by lower sealing surface 119 in abutting relationship with the juxtaposed portion of rim 12.

As the closure is screwed onto the container neck, the rim 12 enters within radially inwardly directed bead 127 until the outer surface abuts said bead 127. The closure is then located and centred by bead 127 as final tightening of the closure is completed. The closure is tightened down until the back surface 121 of sealing ring 116 abuts the annular surface 125 of support ring 124 to positively urge the sealing ring into sealing engagement with the rim 12 of the neck 10 of the container.

In this condition, the generation of pressure within the container itself results in an increase in pressure within the container. The increase in pressure will tend to permeate between the annular support ring 124 and the sealing ring 116 to enter the annulus 140 and to exert pressure on the first flexible portion 117 and the back surface 121 of sealing ring 116 thus enhancing the sealing engagement between member 118 and the rim 12 of the container to which the closure is employed.

It will be appreciated that the flexible portion 117 of the sealing ring 116 is urged and flexed into the relatively low pressure area defined between the outer surface of the rim 12 of the container and the inner surface of the skirt carrying the threads 113.

The closure described above was attached to a test rig including a suitable neck and applied with a torque of 20 lb/inches. A pressure of 160 lbs. per square inch was applied to the inside of the container neck and was maintained for 2 minutes. The removal torque after release of the pressure was 11 to 12 lb./inches.

A container was filled with carbonated water and the above closure applied with a torque of 20 lb./inches. The container was shaken continuously for 14 days and the container referred to above was then stored lying on its side for 80 days. In each case no leakage was noted.

It will be appreciated that the closure described above may be manufactured of any suitable resilient thermoplastics material and depending on the contents of the container, materials such as polypropylene and modified polyethylene being found to be particularly successful. Closures manufactured in accordance with the present invention have been tested with water under laboratory conditions of pressures in excess of 50 lb. per square inch without leaking. It will be appreciated, however, that the degree of pressure seal obtained is dependent on the nature of the plastics material employed, the nature of the contents of the container and the material and uniformity of the sealing surfaces of the container itself.

In the embodiments shown in FIGS. 5 and 6, the support ring 124 is provided with a number of gaps 125', which serve to provide means for the entry of pressure building up within the neck of the container to enter behind the sealing ring 116 as shown in FIG. 6.

It will be appreciated that this facilitates the entry of the pressure behind the flexible sealing ring 116 to enhance the sealing thereof with the container rim.

I claim:

1. A pilfer proof closure for a container having an upstanding neck defining a dispensing opening with a security band portion on the external neck surface thereof, said closure comprising a crown portion adapted to overlay and close said dispensing opening and a skirt depending from the periphery of the crown portion, and including on the internal surface of the skirt, retaining means adapted to cooperate with corresponding retaining means on the container neck, said closure being characterized by the combination of a flexible annular sealing ring depending from the internal surface of the closure inclined inwardly towards the axis thereof, the sealing ring being adapted to engage in sealing relationship with the container neck and a support ring depending from the crown portion and disposed substantially concentrically within the sealing ring to limit flexing of the ring on application of the closure to a container neck, and a skirt extension integrally connected with said skirt through a peripheral weakened skirt portion, said extension being separable from said skirt at said weakened portion and including a resilient pilfer proof security portion including a plurality of tongue elements each hingedly connected with the skirt extension and adapted to extend inwardly thereof to engage the security band portion on the container neck, whereby said security portion on application of the closure to the container neck with relatively low torque enters over the security band portion without rupturing said weakened skirt portion.

2. A closure as claimed in claim 1 characterised in that each tongue is formed with the extremity of the tongue extending upwardly and inwardly of the skirt extension to engage under the lower extremity of the security band.

3. A closure as claimed in claim 1 characterised in that the rupturable portion includes a plurality of circumferential slits extending around the skirt extension between the plane of the tongue elements and the plane defined by the lower extremity of the skirt to define a pilfer proof ring.

4. A closure as claimed in claim 3 characterised in that the pilfer proof ring includes at least one axial line of weakness extending between the peripheral line of weakness constituting a rupturable portion at the lower extremity of the skirt extension.

5. A closure as claimed in claim 1 characterised in that the internal surface of the skirt juxtaposed the sealing ring includes an inwardly projecting annular bead which when the closure is applied to the container abuts a surface of the neck juxtaposed the ring and serves to centre the closure on the container neck as the components are forced into sealing engagement.

6. A closure as claimed in claim 1 characterised in that the support ring is dimensioned to maintain the sealing ring into abutting engagement with the neck of the container without said abutting surface passing through the perpendicular to the closure axis.

7. A closure as claimed in claim 1 characterised in that the support ring has at least one interruption to allow pressure to enter behind the ring to flex the sealing ring into a low pressure area of the closure towards the skirt.

8. A method of closing a container having a dispensing opening and a security band portion on the external neck surface thereof which comprises applying a closure to said container, said closure comprising a crown portion adapted to overlay and close said dispensing opening and a skirt depending from the periphery of the crown portion, and including on the internal surface of the skirt, retaining means adapted to cooperate with associated retaining means on the container neck, said closure being characterized by the combination of a flexible annular sealing ring depending from the internal surface of the closure inclined inwardly towards the axis thereof, the sealing ring being adapted to engage in sealing relationship with the container neck and a support ring depending from the crown portion and disposed substantially concentrically within the sealing ring to limit flexing of the ring on application of the closure to the container neck, and a skirt extension integrally connected with said skirt through a peripheral weakened skirt portion, said extension being separable from said skirt at said weakened portion, and thereafter stamping out in the skirt extension a plurality of tongue elements extending upwardly and inwardly of the lower extremity of the skirt extension whereby the inner extremity of each tongue engages under said security band portion on the container neck.

* * * * *